United States Patent [19]

Weber et al.

[11] Patent Number: 4,588,479

[45] Date of Patent: May 13, 1986

[54] DEVICE FOR COOLING INCANDESCENT COKE

[75] Inventors: Heinrich Weber, Recklinghausen; Kurt Lorenz, Hattingen; Horst Dungs, Herne, all of Fed. Rep. of Germany

[73] Assignee: Firma Carl Still GmbH & Co. K.G., Fed. Rep. of Germany

[21] Appl. No.: 710,031

[22] Filed: Mar. 11, 1985

Related U.S. Application Data

[63] Continuation-in-part of Ser. No. 366,176, Apr. 7, 1982, abandoned.

[30] Foreign Application Priority Data

Apr. 16, 1981 [DE] Fed. Rep. of Germany ..... 3115437

[51] Int. Cl.[4] ..... C10B 39/02

[52] U.S. Cl. ..... 202/228; 202/262

[58] Field of Search ..... 202/95, 253, 222, 228, 202/262; 201/39; 414/287, 304; 222/457, 353

[56] References Cited

U.S. PATENT DOCUMENTS

| | | | |
|---|---|---|---|
| 679,479 | 8/1901 | Hirt | 202/227 |
| 1,818,567 | 8/1931 | McIntire | 202/262 |
| 2,008,334 | 7/1935 | Niles | 202/253 |
| 2,752,298 | 6/1956 | Hughes | 202/253 |
| 4,288,294 | 9/1981 | Velling | 201/39 |
| 4,338,161 | 7/1982 | Weber et al. | 202/228 |
| 4,370,202 | 1/1983 | Weber et al. | 202/228 |

FOREIGN PATENT DOCUMENTS

| | | | |
|---|---|---|---|
| 531944 | 2/1925 | Fed. Rep. of Germany | 201/39 |
| 529213 | 12/1929 | Fed. Rep. of Germany | 201/39 |
| 1080968 | 5/1960 | Fed. Rep. of Germany | 202/228 |
| 2952065 | 2/1981 | Fed. Rep. of Germany | 202/228 |

*Primary Examiner*—Peter Kratz

*Attorney, Agent, or Firm*—McGlew and Tuttle

[57] ABSTRACT

A device and method for dry cooling incandescent coke comprises a closed cooling chamber having a coke inlet, for example, at its top end and a coke delivery or discharge at its bottom end which is subdivided by a plurality of vertical walls so as to leave coke flow spaces between the walls. The walls are constructed to define a continuous meandering path for coolant which is circulated through the walls during the flow of coke therethrough. The walls comprise superposed ducts arranged vertically one over the other and which for example are welded together and which have respective ends connected to a superjacent or subjacent duct so as to form a continuous meandering coolant flow passage. The coolant is circulated through inlet and outlet connections arranged exteriorly of the chamber and the coke flow and coolant flow are controlled through the chamber as desired to affect the cooling rate selected.

7 Claims, 9 Drawing Figures

DEVICE FOR COOLING INCANDESCENT COKE

CROSS-REFERENCE TO RELATED APPLICATION

This is a continuation-in-part application of Ser. No. 366,176 filed Apr. 7, 1982 now abandoned.

FIELD AND BACKGROUND OF THE INVENTION

This invention relates in general to coking devices and in particular to a new and useful device for dry cooling incandescent coke.

A related patent (German No. P 30 13 722.5; U.S. Pat. No. 4,338,161) discloses a dry system for cooling incandescent coke in a closed cooling chamber while recovering the sensible heat of the coke, which heat dissipates partly directly to an inert circulating gas and partly indirectly through cooling surfaces to a cooling liquid. The cooling chamber is designed as an annular receptacle which is subdivided into compartments by cooling walls through which a coolant is directed and which are spaced from each other by from 600 to 1200 mm depending on the nature of the coke. Each of the compartments is connected to a coke delivery mechanism by which the cooled coke is discharged into an afterchamber. All of the coke discharge mechanisms are of identical design and drivable through one or more synchronous drives. Cooling gas supply conduits with outlet nozzles and with a slant and a valve for controlling the gas flow are provided in the compartments above the discharge mechanism.

As a particular feature of the related patent, the cooling walls are an assembly of juxtaposed tubes which extend vertically in the cooling chamber. The individual tubes are connected to each other by webs. For example, according to FIG. 1 of the related patent, the parallel heating walls 10 in the cooling chamber are connected to lower distributing lines 11 for the coolant, and upper collecting lines 12. Already for reasons of a uniform distribution of the coolant, the distributing and collecting lines must have considerably larger cross sections than the cooling tubes proper of the wall. This considerably narrows the coke flow passages above and below the cooling walls.

SUMMARY OF THE INVENTION

A development of the invention has proved advisable and advantageous according to which the cooling walls are made of a plurality of horizontally extending, superposed ducts which are welded to one another longitudinally on both sides and communicate on one end with the superjacent duct and on the other end with the subjacent duct, so that the coolant can meander through the wall from below, upwardly or inversely. The favorable effect of this design is that the coke to be cooled can slide down the cooling chamber along smoother wall surfaces. In accordance with the invention, the ducts may be formed by tubes having a rectangular, channel, semicircular, etc. cross section.

The design of the cooling walls in accordance with the invention has the advantage of a particularly simple assembly. The sections, which may be conventional, are placed one on the other and welded together along the longitudinal edges of their base surfaces. At the ends, a bond is added deflecting the flow to the super-or-subjacent duct. In addition, the inventive cooling wall is very strong and stable. If necessary, at little expense, thin, flat, wear plates may be provided covering the surfaces coming into contact with the coke.

The related patent does not provide a pump for circulating the coolant through the cooling walls. Experience has shown, that this requires 20 to 25 natural cycles of the coolant circulation to produce the necessary vapor or dissipate the corresponding heat amount. In a forced circulation, about 8 to 12 coolant cycles would be sufficient with the same system. With the novel design of the cooling wall, the circulating coolant remains in the cooling chamber much longer, which means that a substantially lower amount is to be circulated and substantially less power therefor is needed.

Particularly in cooling walls of larger dimensions, a development of the invention has proved advantageous according to which, in at least two superposed ducts, a coolant flows in the same direction, and the downstream ends of the ducts are each connected to a duct where the coolant flows in the opposite direction. Such superposed ducts of identical flow direction may open into a common vertical duct which is connected through distributing nozzles to a bank of ducts where the coolant flows in the opposite direction. Due to this collection of the flow after each passage in one direction, the coolant portions are intensely mixed.

In proportion to the number of superposed ducts forming a bank of identical flow direction, the length of the individual ducts forming the bank may considerably be reduced. For example, with two ducts in a bank, their lengths are halved, with five ducts, they are reduced to one fifth. In this simple way, excessive thermal loads on the heated surfaces can be avoided.

A completely smooth surface over the entire height of the cooling wall may be obtained, in accordance with the invention, by providing the lines for distributing and collecting the coolant to and from the walls, and consequently also the respective connections, outside the cooling chamber. This eliminates a narrowing of the upper and lower cross sectional areas for passage of the coke. A coolant adjustment may thus be effected in a simple way and during operation, at the externally extending distributing and collecting lines for the individual cooling walls, and the problem of distributing the coolant to the individual vertically extending tubes in each cooling wall is thereby eliminated.

With a plurality of ducts combined to a bank of identical flow direction, it has been found advisable in addition to dispose the collecting vertical ducts also outside the cooling chamber, which simplifies the adjustment of the individual distributing nozzles.

Further, still in accordance with the invention, the top of the uppermost duct of a bank of ducts and/or of a cooling wall may be provided with a wedge-shaped upwardly tapering ridge. This facilitates the sliding motion of the hot coke along the cooling walls.

Accordingly, an object of the invention is to provide a device for dry cooling incandescent coke which comprises a closed cooling chamber having an upper end for receiving coke and a lower discharge end and a coke flow space therebetween which is divided by a plurality of substantially vertical spaced apart cooling walls which extend across the flow space so that the spaces therebetween define vertical passages for the coke and wherein the walls comprise superposed horizontally extending ducts communicating at respective ends with the next subjacent and superjacent duct so as to form a continuous coolant flow passage for circulating coolant during the flow of the incandescent coke in the individual flow passages between the walls.

A further object of the invention is to provide a method of dry cooling incandescent coke which comprises passing the coke through a plurality of vertical passages defined between coolant walls and circulating coolant in a counterflow meandering path through the coolant walls as the coke is moved therebetween.

A further object of the invention is to provide a device for dry cooling incandescent coke which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
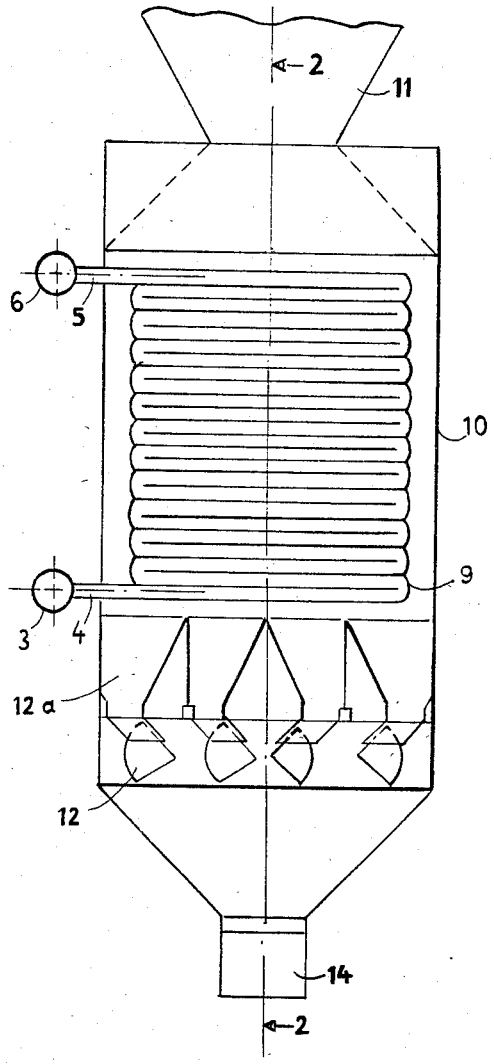
FIGS. 1 and 1*a* are schematic vertical sectional views of vessels for dry cooling incandescent coke constructed in accordance with the invention.

Referring to the drawings in particular, the invention embodied therein comprises a device for dry cooling incandescent coke which comprises a closed cooling chamber 10 having an upper end with a charging hopper 11 for receiving coke and a lower end 20 which discharges into a lower conveyor 14.

In accordance with the invention a plurality of substantially vertical spaced planar cooling walls generally designated 1 extend across a coke flow space defined at the interior of the cooling chamber 10 and subdivide the flow space into a plurality of separate vertical passages for the coke to flow from the charging hopper downwardly through the discharge end 20 to the lower conveyor 14. The chamber is rectangular in horizontal section. In accordance with the invention, the cooling walls 1 comprise superposed substantially horizontal metal tubes or ducts 2 which communicate at their respective ends with the next adjacent respective superjacent and subjacent ducts so as to form a continuous meandering coolant flow passage. A coolant distributing line 3 connects into an inlet end 4 of the flow passage of the coolant is circulated through the wall 1 and discharged through a discharge end 5 to a collecting line 6.

The figures, which use like numbers to designate like similar parts, show a cooling chamber 10 and the inventive cooling walls 1. Cooling walls 1 are substantially formed by superposed ducts 2 which are connected to one another by horizontal welds 8. On their ends, two superjacent ducts 2 are connected to each other by circularly bent end connections 9, so that the coolant flows along a zig zag path sequentially through adjacent ducts in opposite directions. Depending on the required condition of flow and heat dissipation, ducts 2 may have a square or rectangular cross section. The term rectangular as used here is meant to include square.

Figure 2:
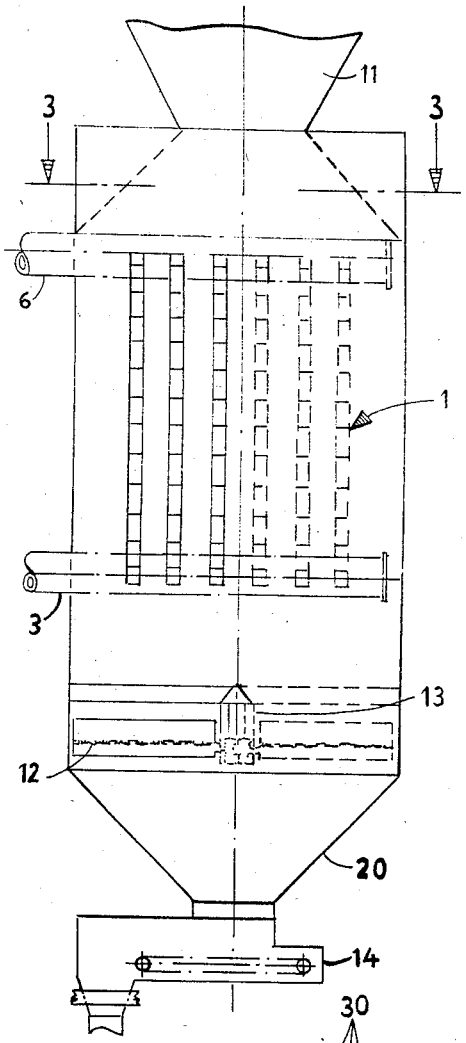
FIG. 2 is a schematic sectional view taken along the line 2—2 of FIG. 1.
Figure 3:
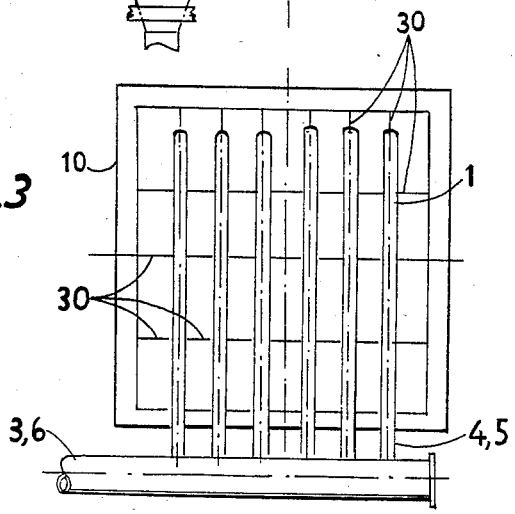
FIG. 3 is a section taken along the line 3—3 of FIG. 2.
Figure 1A:
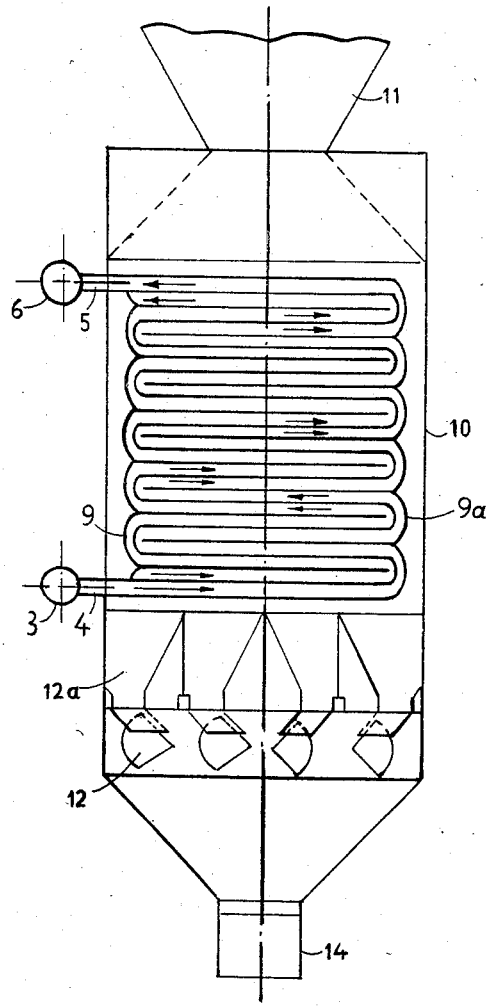
Figure 2A:
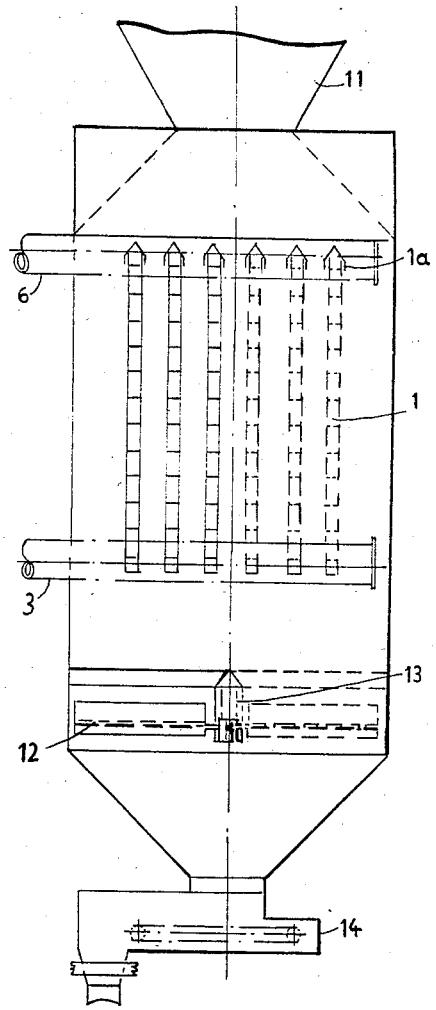
FIG. 2*a* is a view similar to FIG. 2 but showing a ridge for the cooling walls.
Figure 4:
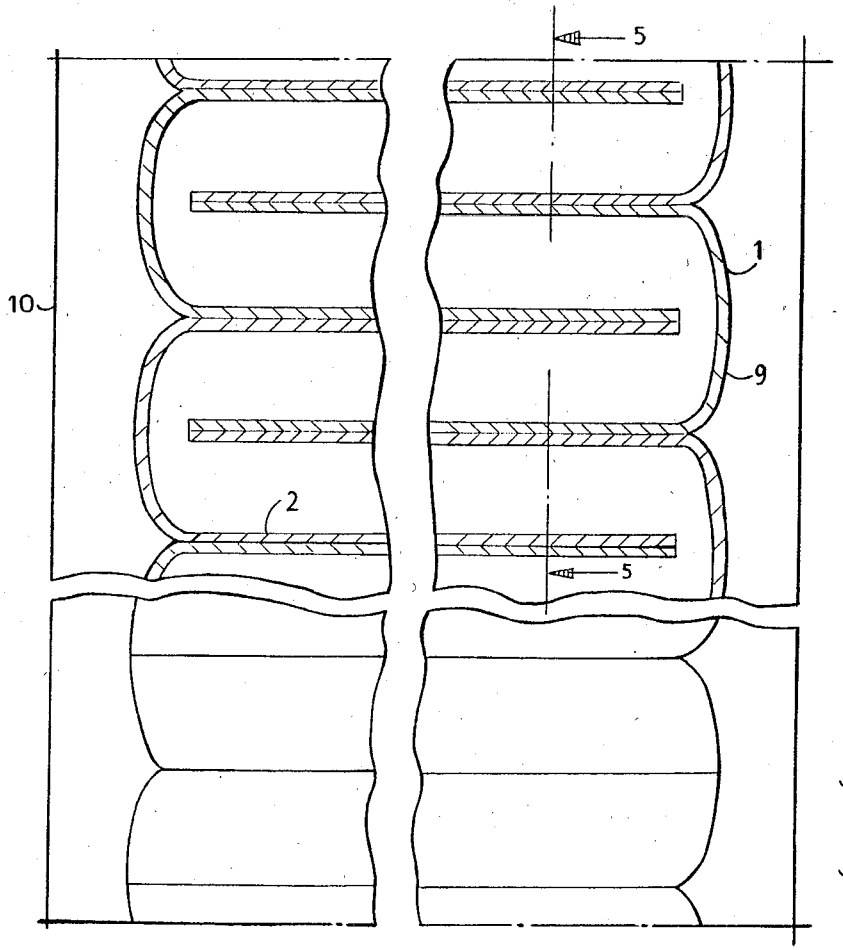
FIG. 4 is an enlarged partial sectional and partial elevational view showing a coolant wall constructed in accordance with the invention.
Figure 5:
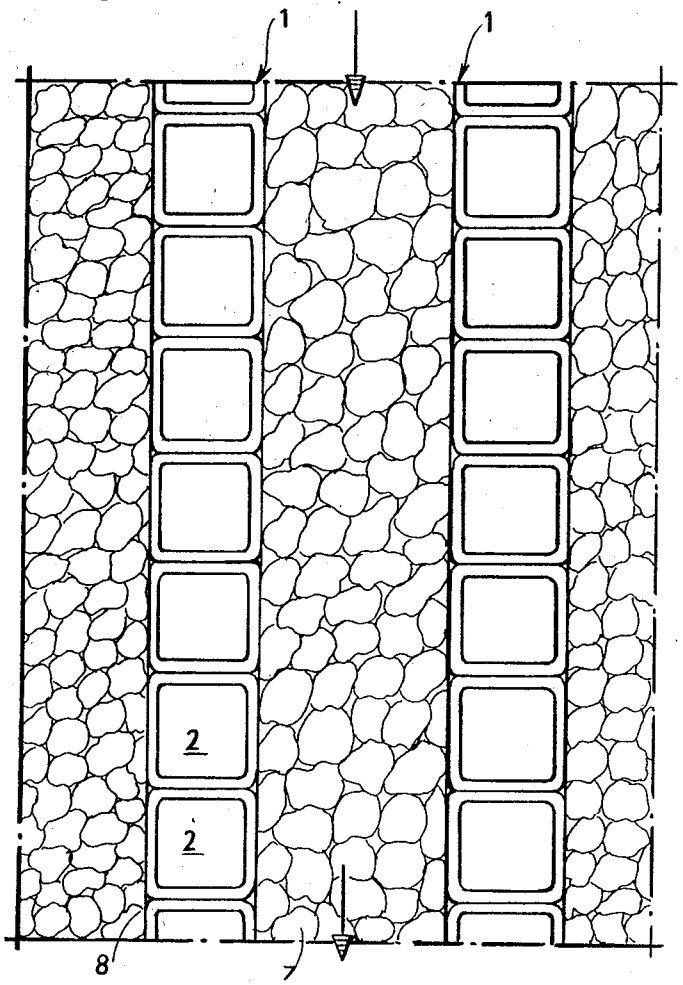
FIG. 5 is a section taken along the line 5—5 of FIG. 4.

FIGS. 1 to 3 show that the distributing lines 3 and the collecting lines 6 are provided outside the cooling chamber 10. Connections 4 and 5 of the respective lines 3 and 6 extend through the wall of cooling chamber 10 to the individual cooling walls 1. With this arrangement, temperature and flow control devices (not shown) for the individual cooling walls also are provided outside the cooling chamber, in the connections 4 and 5.

The other elements of equipment of the cooling chamber 10 include a top charging hopper 11, discharge mechanism with tippers 12, a central dome structure 13, and lower conveyor 14, are schematically indicated.

In accordance with the method of the invention, coke is cooled by letting it flow at a defined rate vertically through a chamber having a plurality of spaced apart cooling walls while a coolant is circulated through the cooling walls in a meandering path first in one direction across the cooling wall and then backwardly in another direction across the cooling wall above the first path and so on up to the top of the cooling wall.

Referring to FIG. 3, the vertical walls 10 and the parallel cooling walls 1 are provided with additional partitions 30 most of which extend transversely to walls 1 while some are connected from the ends of the walls to the vertical walls of the cooling chamber 10. This divides the chamber 10 into a plurality of individual passages or compartments, with twenty eight such compartments being shown in the embodiment of FIG. 3. To obtain a uniform cooling of the coke in the cooling chamber, the discharge of the coke at the lower end of the vertically extending individual compartments must correspondingly be controlled. Therefore the cooled coke is removed at the lower end of the cooling chamber in metered amounts through outlets 12*a* and discharge mechanisms 12.

Figure 6:
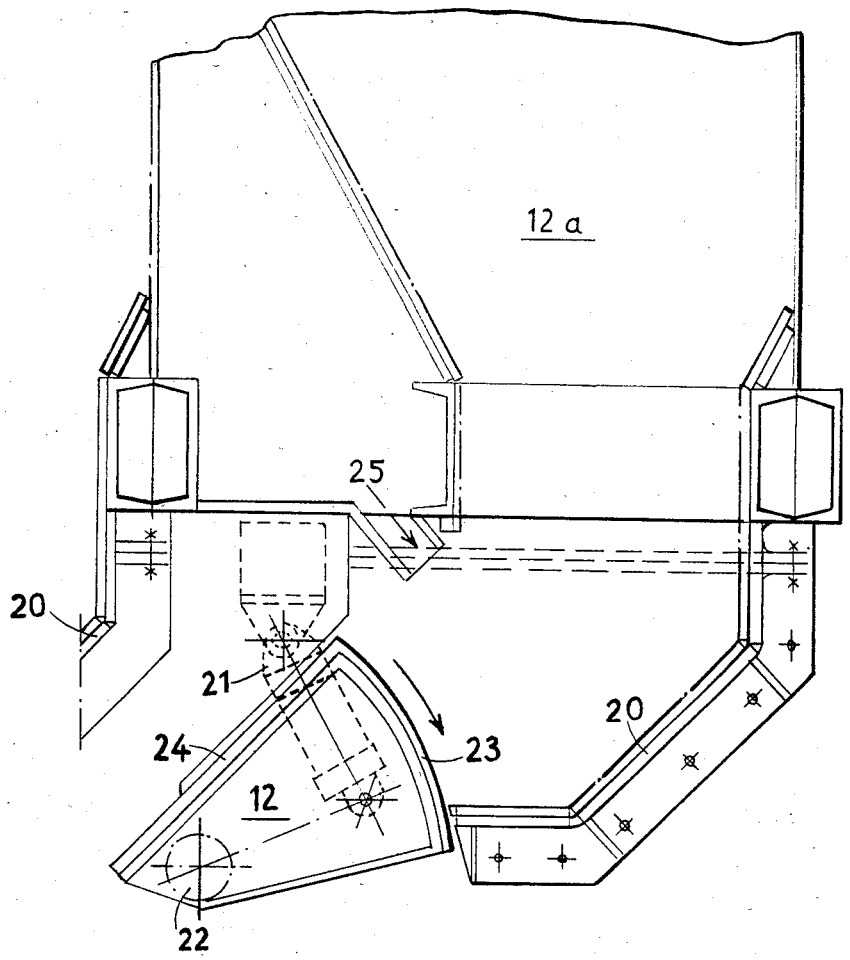
FIG. 6 is an enlarged sectional view of the discharge mechanism for discharging coke from the dry cooling vessel.
Figure 7:
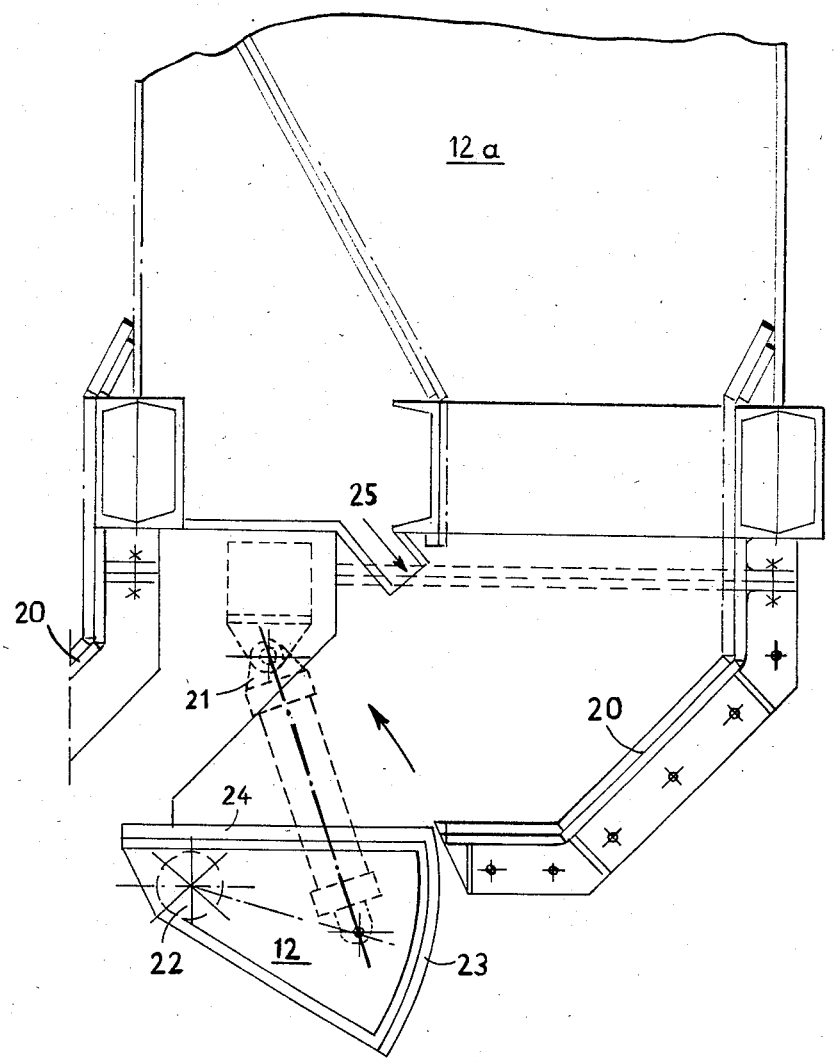
FIG. 7 is a view similar to FIG. 6 showing the discharge mechanism in a position for discharging coke from the bottom of the vessel.

Referring to FIGS. 6 and 7 which show the discharge mechanism in greater detail, eight outlets 12*a* are provided each for servicing two of the compartments. Each outlet 12*a* comprises a chute which is suitably shaped to permit coke to slide down to the bottom of the outlet. At the bottom, i.e. the narrowest cross-sectional area of the chute, eight tippers 12 are provided. Each one can be pivoted by a hydraulic piston, cylinder combination 21, from an upward position shown in FIG. 6 to a lower position shown in FIG. 7. Each has a flat coke receiving surface 24 and a curved coke stopping surface 23. Each tipper is mounted for rotation about a pivot journal 22 with the curvature of stopping surface 23 being centered on pivot journal 22 so that the lower walls 20 of the chamber outlet maintains close association with surface 23 throughout its pivotal movement to avoid the leakage of coke.

In the position of FIG. 7, coke slides down outlet 12*a* onto the flat surface 24. The coke tends to stay in this position since the surface 24 as well as a short portion of lower wall 20 lie in a horizontal plane. To meter out a quantity of coke, tipper 12 is pivoted into its position shown in FIG. 6. The coke lying on surface 24 thus slides down and out the end of the vessel. Cooling gas is provided through outlet 25.

The narrowest part of chutes 20 for outlet 12*a* are each about three meters long. When the tipper is in its position shown in FIG. 6, to discharge coke that previously rested in surface 24, the arcuate stopping surface 23 prevents additional coke from sliding out of the vessel.

After a short period of time, the tipper is returned to its position shown in FIG. 7 for receiving an additional charge of coke.

Above each of the individual tippers 12, the temperature of the coke is determined by means of a thermocouple (not shown) and a cycle for actuating the tippers is determined as a function of this temperature. If the coke temperature exceeds a predetermined value, the respective tipper may automatically be stopped.

While a specific embodiment of the invention has been shown and described in detail to illustrate the application of the principles of the invention, it will be understood that the invention may be embodied otherwise without departing from such principles.

What is claimed is:

1. A device for dry cooling incandescent coke, comprising a closed cooling chamber having an upper end for receiving coke, a lower discharge end and a coke flow space between the receiving end and discharge end, a plurality of substantially vertical spaced apart cooling walls extending across said flow space and subdividing the flow space into a plurality of separate vertical passages for the coke, said walls comprising superposed, substantially horizontal substantially rectangular abutting metal tubes communicating at respective ends with the next superjacent and subjacent rectangular tubes so as to form a continuous coolant flow passage, said cooling chamber being rectangular in horizontal cross-section, each wall extending in a vertical plane which is parallel and horizontally spaced from each other wall to form opposite planar vertical side surfaces for each vertical wall, said coolant flow passages at each end including a respective inlet and outlet connection and including a distributing line connected to every inlet connection and a collecting line connected to every outlet connection, a plurality of partitions connected between adjacent ones of at least some of said walls for dividing said continuous coolant passage into a plurality of compartments, said partitions extending between adjacent walls and perpendicularly to said adjacent walls, and metered discharge means connected to said cooling chamber at said lower discharge end thereof for discharging coke from said compartments in a metered fashion, said metered discharge means including a plurality of separate discharge openings each for at least one compartment and each including a chute, and a tipping member at an end of each chute for metering out a selected amount of coke from each chute.

2. A device according to claim 1, wherein each tube of each wall is welded to a subjacent and superjacent tube at each side, top and bottom to form said opposite planar vertical side surfaces for each vertical wall.

3. A device according to claim 2, wherein said distributing and collecting lines are disposed outside said cooling chamber.

4. A device according to claim 2, wherein said metal tubes are square in cross-section.

5. A device according to claim 2, wherein at least two superposed tubes form a bank of tubes for conducting coolant in the same direction which communicates with at least two other tubes for the passage of coolant in an opposite direction.

6. A device according to claim 2, wherein an uppermost tube of each wall is provided at its top with an upwardly projecting wedge shaped ridge.

7. A device according to claim 1, wherein said tipping member is pivotally mounted about a horizontal axis and includes a flat coke receiving surface and a curved coke stopping surface which has a curvature centered on said horizontal axis, and means for moving said tipping member into a position with said coke receiving surface inclined for discharging coke from a top thereof and into a position with said coke receiving surface horizontal for collecting coke thereon, said lower discharge end of said cooling chamber including a lower chute wall cooperating with said coke stopping surface for holding coke back in said chamber.

* * * * *